114-253 SR
3/11/86 OR 4,574,723

United States Patent [19]
Chiles et al.

[11] Patent Number: 4,574,723
[45] Date of Patent: Mar. 11, 1986

[54] PARAVANE HANDLING SYSTEM

[75] Inventors: Michael J. Chiles, Victoria; Harvey M. Babb, Goliad, both of Tex.

[73] Assignee: VMW Industries, Inc., Victoria, Tex.

[21] Appl. No.: 691,289

[22] Filed: Jan. 14, 1985

[51] Int. Cl.[4] ..... B63B 21/04
[52] U.S. Cl. ..... 114/253
[58] Field of Search ..... 114/244–245, 114/253, 243, 311; 244/1 TD

[56] References Cited

U.S. PATENT DOCUMENTS

| | | | |
|---|---|---|---|
| 346,689 | 8/1889 | Schoening | 114/311 |
| 2,980,052 | 4/1961 | Fehlner | 114/245 |
| 3,774,570 | 11/1973 | Pearson | 114/245 |
| 4,033,278 | 7/1977 | Waters | 114/245 |
| 4,270,479 | 6/1981 | Baker et al. | 114/245 |

*Primary Examiner*—S. D. Basinger
*Assistant Examiner*—Jesûs Sotelo
*Attorney, Agent, or Firm*—Jerry W. Mills; Gregory M. Howison

[57] ABSTRACT

A paravane handling system which includes a wing-shaped paravane (40) connected by four lines to a hitching device (28) which in turn is connected by a main line (26) to a winch onboard a vessel (10). The main line (26) is arranged to have air gun cable arrays attached thereto for surveying the ocean floor. Vessel (10) also includes a drum retrieval winch (18) for controlling a retrieval line (20) which is connected to a latching mechanism (24) arranged to run along the main line (26) and engage with the hitching device (28) of the paravane (40). A unidirectional stop (42) is released when the latching mechanism (24) is pulled back toward the vessel (10) and allows the lower two paravane lines (34) and (36) to slacken so that the paravane (40) assumes a horizontal position and planes along the surface of the water as it is pulled back to vessel (10) by the retrieval line (20). The paravane (40) also includes a winch device (78) which is remotely controllable by an operator onboard the vessel (10) to change the length of the rear paravane lines (36) and (38) to the hitching device (28) and thereby change the angle of incidence of the paravane relative to the water. Another paravane construction (100) includes remotely controllable rudder devices (108) and (110) for varying the angle of incidence and therefore the direction of travel of the paravane. A propeller driven generator (88, 130) supplies power to the controlled elements of the respective paravane constructions.

13 Claims, 11 Drawing Figures

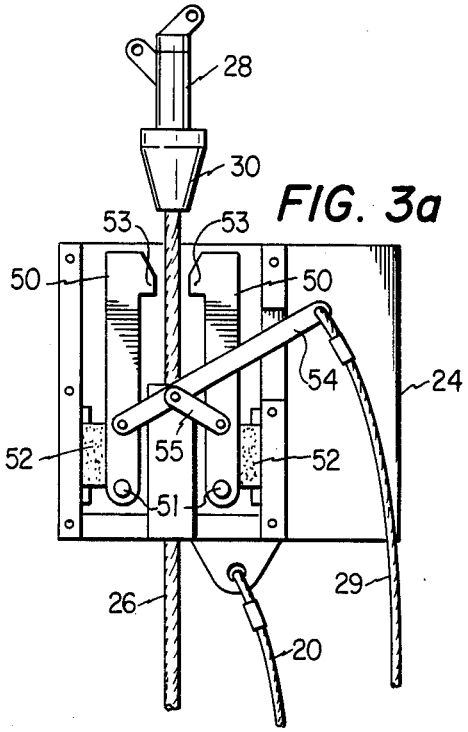
FIG. 3a
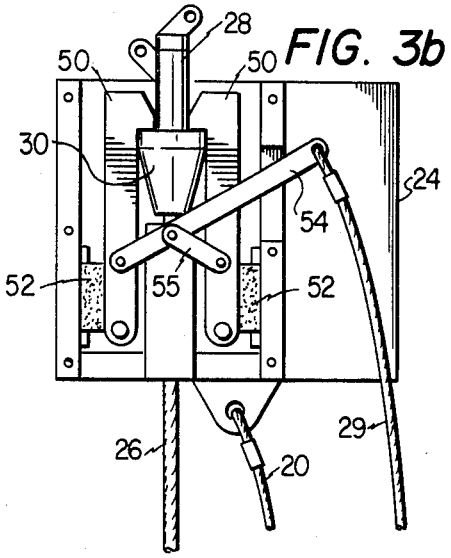
FIG. 3b
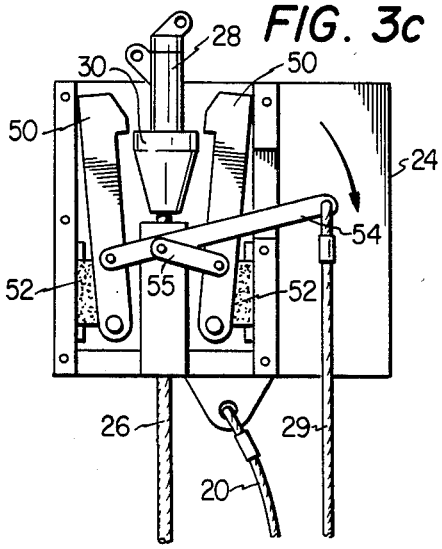
FIG. 3c
FIG. 6
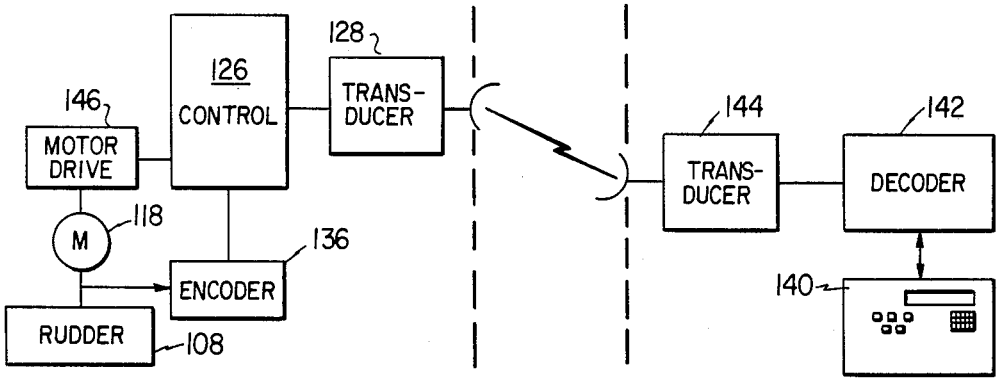

PARAVANE HANDLING SYSTEM

TECHNICAL FIELD

The present invention relates generally to systems for surveying the ocean floor and more specifically to a paravane deployment and handling system for deploying and controlling seismic detectors behind a moving vessel.

BACKGROUND OF THE INVENTION

In exploring for oil under the sea, surveyors onboard a ship typically deploy air gun cables and streamer cables behind the moving vessel. The air gun cables include a string of acoustic guns which generate acoustic signals which are transmitted into the ocean floor and reflected from rock formations below the ocean floor. The streamer cables are equipped with hydrophones which detect the reflected acoustic energy.

In practice, when it is desired to deploy air gun cable strings from a moving vessel, a tow cable is attached at one end thereof to the vessel and a wingshaped paravane is attached to the tow cable at the other end. The air gun strings are then attached to the tow cable and paid out to the desired position on the tow cable. When underway, the paravane will pull the air gun cable away from the vessel and toward a point perpendicular to the path of the vessel. The paravane thus insures that the air gun cable is stretched out to its full extent and maintained at a constant tension during the surveying operation. The wing shape of the paravane creates an outward force on the paravane along the direction of the tow line connected between the ship and the paravane, and the angle of incidence or attack of the wing-shaped paravane in the water determines its direction and the angle of deployment relative to the path of the vessel.

In existing paravane systems, the lines connecting the paravane to the ship are arranged so that the paravane is maintained in a nonvariable, substantially vertical position in the water. The pull forces created by the paravane angle of attack in combination with the forces created as a result of the wing shape of the paravane thus insure maximum extension from the vessel. Problems with these existing systems has arisen, however, because the paravane have been relatively uncontrollable during normal operation and extremely difficult to tow onboard the towing vessel when the survey is completed. For example, since prior paravanes are normally maintained perpendicular to the tow cable, substantial force must be exerted to bring in the paravane. Further, prior paravanes are difficult to bring onboard from the water without hitting against the tow ship. Moreover, prior paravanes which have fixed attack angles cannot be varied in order to vary the ultimate position of the paravane or the force exerted on the tow cable by the paravane. The present invention obviates those disadvantages by providing an improved handling system for deploying and retrieving air gun tow cables and the attached paravane. The system includes means for selectively controlling the attack angle and movement of the paravane and permits easy retrieval of the paravane and cable once the surveying operation is completed.

SUMMARY OF THE INVENTION

The present invention described and disclosed herein comprises an improved paravane handling system including means for selectively controlling the direction of movement of the paravane from a control panel onboard a towing vessel. In accordance with the invention, electronic circuitry is provided onboard the paravane and is responsive to signals transmitted from the vessel to move the paravane in the desired direction. Means are also provided so that an operator onboard the towing vessel may selectively change the attitude of the paravane in the water so that the paravane may be easily retrieved with minimal water resistance.

In the preferred embodiment, the paravane is attached to the vessel by a bridle of four paravane lines and a tow cable. Each of the paravane lines is attached to a corner of the paravane and are joined together at a common hitch. The system also includes a latching mechanism which is designed to be deployed along the tow cable and to engage the hitch when it is desired to retrieve the paravane. Upon engagement, the lower two paravane lines are lengthened to permit the paravane to rotate to a horizontal position and lie relatively flatly on the surface of the ocean. The paravane can then be pulled aboard the vessel with minimal water resistance.

In the preferred embodiment, two of the paravane lines are connected to a winch device within the paravane. The winch device is selectively and remotely operable in response to signals received from the towing vessel to vary the length of the paravane lines and thus vary the angle of attack or incidence of the paravane in the water.

In an alternative embodiment, the paravane includes rudders which are selectively remotely controlled from the vessel by means of a servo motor system mounted within the paravane.

BRIEF DESCRIPTION OF THE DRAWINGS

A more complete understanding of the present invention may be had by reference to the following Detailed Description, taken in conjunction with the accompanying drawings, in which.

FIGS. *2a–2d* show the method for deployment and retrieval of the paravane of the present invention.

FIGS. *3a–3c* show the operation of the latching mechanism during deployment and retrieval of the paravane. during deployment and retrieval of the paravane.

Figure 4:
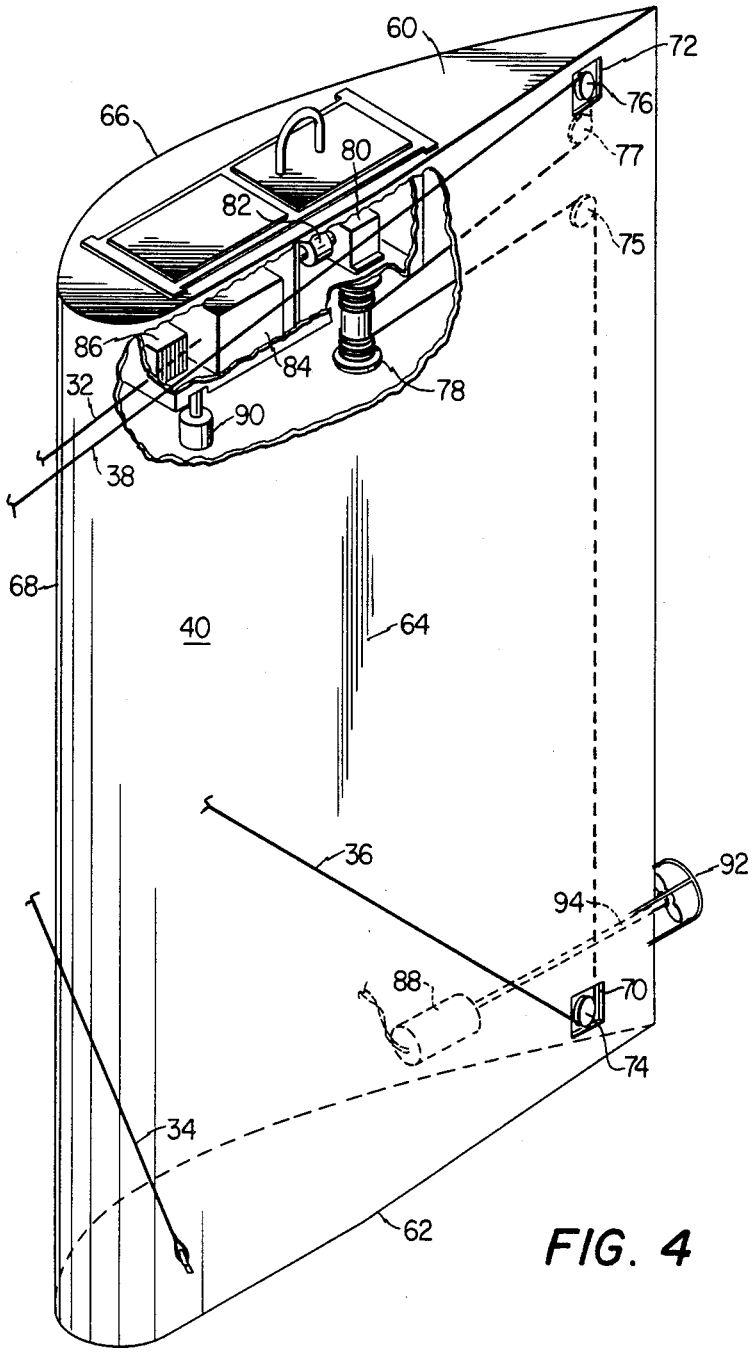
Figure 5:
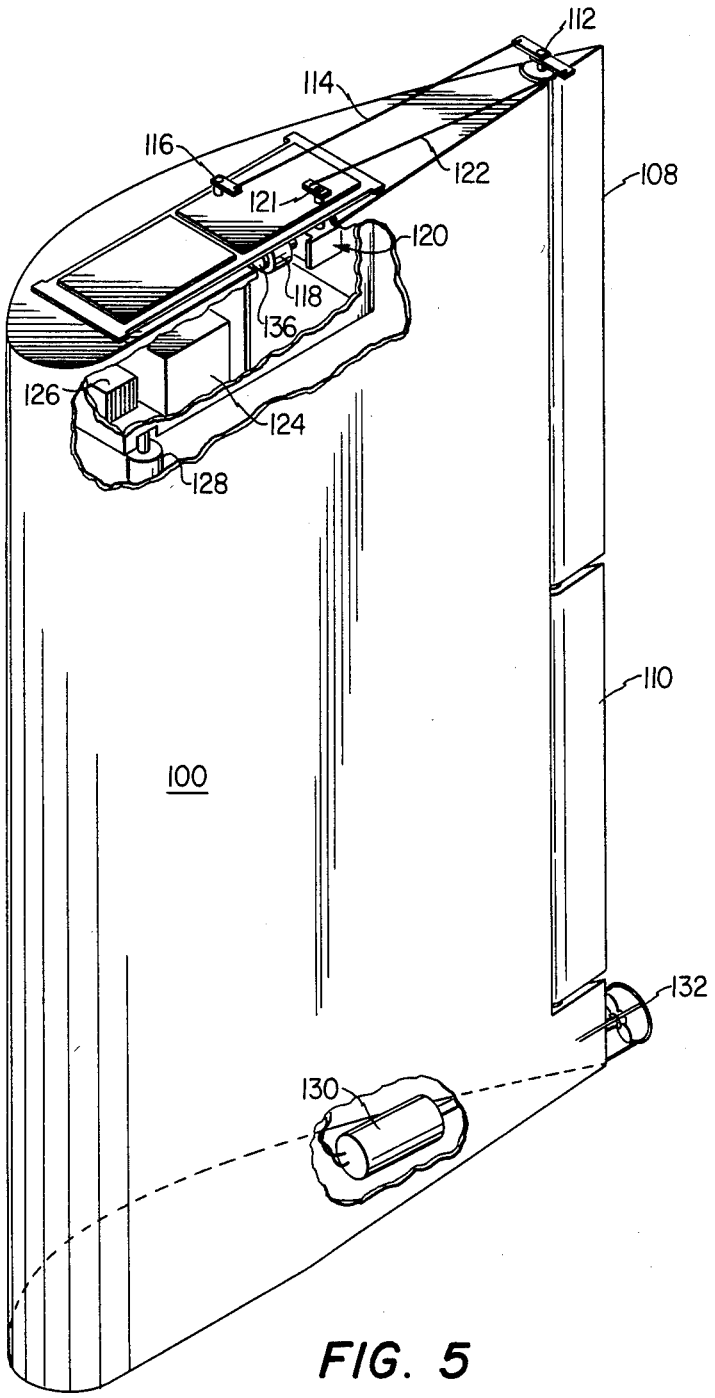

FIG. 4 is a sectional area of the paravane of the present invention;

FIG. 5 is a sectional view of an alternative embodiment of the paravane of FIG. 2;

FIG. 6 is a schematic drawing of the electrical controls for the paravane handling system.

DETAILED DESCRIPTION OF THE INVENTION

Figure 1:
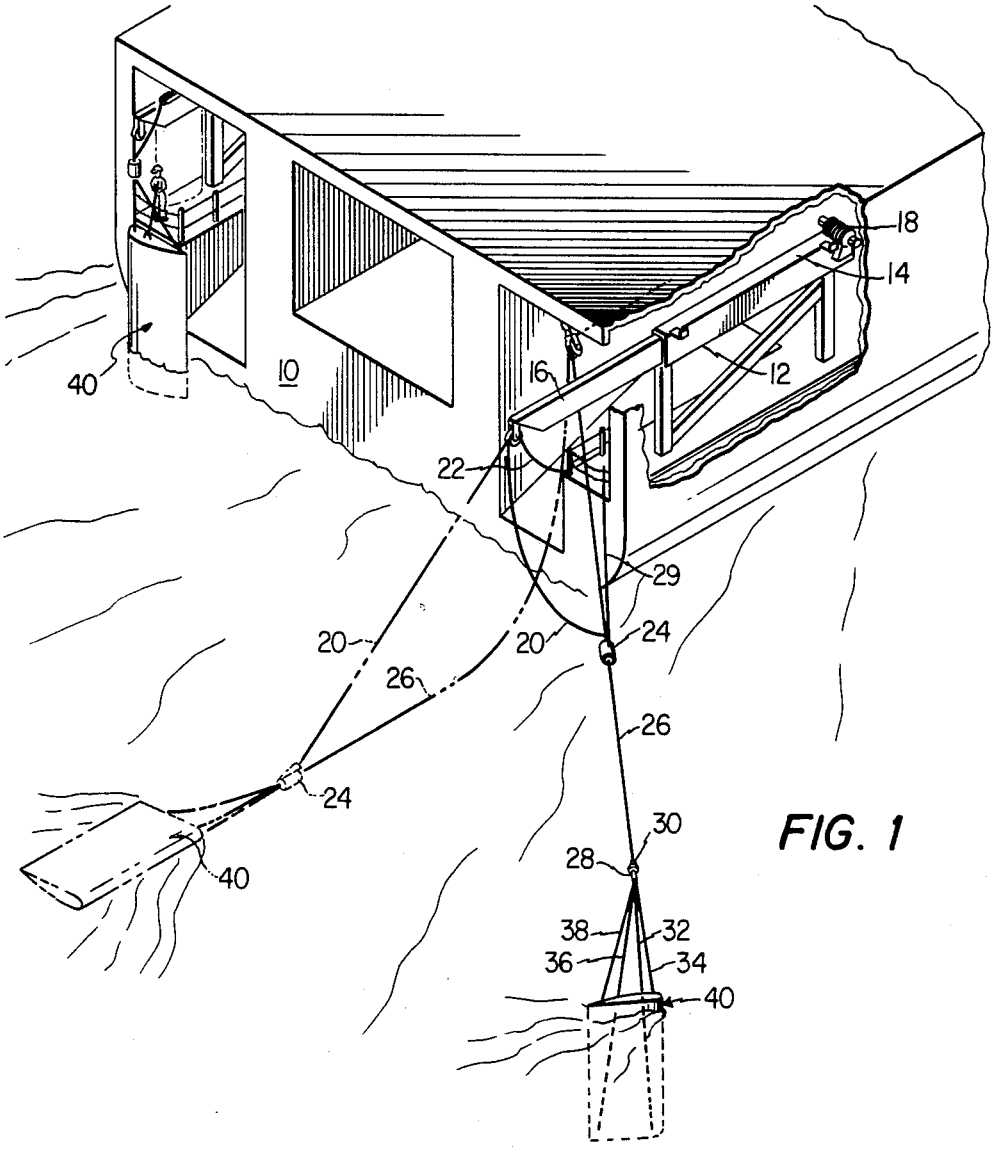
FIG. 1 is a perspective view of the paravane handling system showing the paravane in the working and retrieval positions.

Referring now to the drawings wherein like reference numerals designate like or corresponding parts throughout, FIG. 1 is a perspective view of the paravane handling system of the present invention and shows the paravane in a working position, a retrieval position, and a slowed position. As shown in FIG. 1, survey vessel 10 includes a telescoping boom 12 mounted on the aft section of the vessel. The telescoping boom 12 has a stationary member 14 and a telescoping member 16 slideably engaged therein. A double drum retrieval winch 18 is mounted on the telescoping boom 12 and is selectively operable to control a retrieval line 20 and a storage lift line 22. The retrieval line 20 is connected to a latching mechanism 24. A second winch (not shown) onboard vessel 10 controls a main line 26 which is connected to a hitching device 28. The latching mechanism 24 is arranged to fit around main line 26 and be slideably moveable thereon to selectively engage and disengage with hitching device 28. A release line 29 is also coupled to latching mechanism 24 and is manually operated to disengage latching mechanism 24 and hitching device 28 as described hereinafter in greater detail with reference to FIGS. 3*a*–3*c*.

Hitching device 28 includes a locking member 30 at one end thereof arranged to mechanically lock into latching mechanism 24. Hitching device 28 also includes four paravane lines 32, 34, 36 and 38, each of which is connected to a corner of a paravane 40. The upper paravane lines 32 and 38 are fixedly attached to hitching device 28. The lower paravane lines 34 and 36 are connected to a limit lug or stop 42 (FIGS. 2*a*–2*d*) which permits the lines to be selectively shortened or lengthened for manipulating the position of the paravane as described hereinafter in greater detail. The main line 26 extends through hitching device 28 and is tied to lug 42, as best seen in FIGS. 2*a*–2*d*. As shown in FIG. 1, paravane 40 will be positioned substantially vertically in the water during the surveying operation and will be rotated to a substantially horizontal position for retrieval. Before launch, the paravane is positioned in a stowed upright position with storage life line 22 manually positioned onto a boat hook (not shown) by the operator. Storage life line 22 is operable to lower paravane 40 upon deployment thereof and raise it back to its towed position when the survey operation is completed.

In FIGS. 2*a*–2*d*), an elevational view of the operation of latching mechanism 24 and hitching device 28 is shown as paravane 40 is deployed and retrieved from its operating position. Hitching device 28 is connected to main line 26 and is also connected to lines 32 and 38 at the top portion of paravane 40. Lower lines 34 and 36 are connected to limit lug 42. Main line 26 extends through hitching device 28 and is tied to lug 42. As shown in the figures, the topmost surface of paravane 40 is constructed so that it slopes downwardly from the outer face 44 to the inner face 46 to further reduce its resistance to water as it is being retrieved.

Figure 2A:
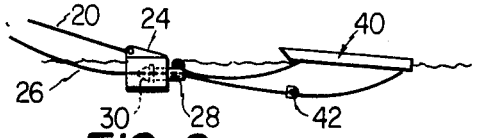

In operation, when it is desired to deploy paravane 40, the operator lowers the paravane into the water with main line 26 and latching mechanism 24 connected to hitching device 28 (FIG. 2*a*). As it is deployed, the paravane 40 lies horizontally on the water as shown in FIG. 2*a* and planes until a sufficient length of main line 26 is paid out from vessel 10 as the vessel moves forward. Air gun strings (not shown) are attached to the main line 26 and paid out to the desired position on main line 26. In this manner, several air gun strings may be towed behind the vessel parallel to each other and a fixed distance apart.

Figure 2C:
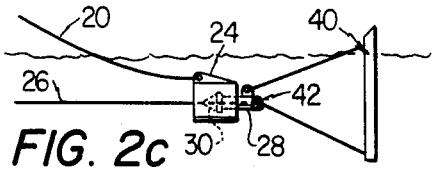
Figure 2B:
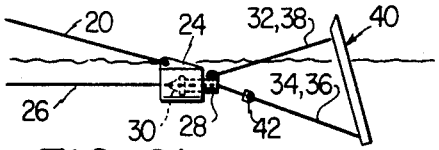
Figure 2D:
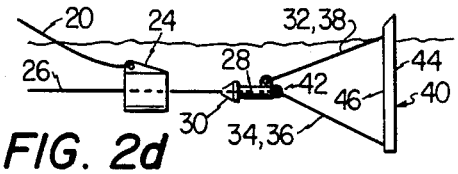

The wing shape of paravane 40 creates an outward force on the paravane so that the paravane causes main line 26 to be stretched out to its full extent. The operator then pulls back on main line 26 to tension the main line, thereby pulling lower paravane lines 34 and 36 through hitching device 28 until limit, lug 42 abuts with hitching device 28 (FIGS. 2*b* and 2*c*). Paravane 40 is then forced into a vertical or operating position. As limit lug 42 comes into contact with the hitching device 28, the lug is locked in place. Latching mechanism 24 is then released and pulled onboard vessel 10. Once it assumes a vertical position paravane 40 pulls main line 26 outwardly from the vessel perpendicular to the path of the vessel and maintains tension on main line 26. Signals may then be transmitted to and from the paravane to reposition the paravane to a greater or lesser perpendicular distance from the path of the vessel as described hereinafter. The retrieval process for retrieving paravane 40 to vessel 10 at the completion of the surveying operation is implemented by simply reversing the sequence of operations described above.

FIGS. 3*a*–3*c* illustrate a sectional view of latching mechanism 24 and show the coupling and uncoupling of latching mechanism 24 and hitching device 28. As shown in FIG. 3*a*, latching mechanism 24 is slidably disposed onto main line 26 and is coupled to retrieval line 20. Latching mechanism 24 is comprised of a housing having an open end for receiving locking member 30 of hitching device 28. Latching mechanism 24 also includes a pair of substantially identical pivotable latch arms 50 disposed at either side thereof and defining a central opening therebetween. Arms 50 are pivoted at one end by pivots 51 and include locking teeth 53 at the other end thereof. Rubber springs 52 are disposed adjacent each of latch arms 50 proximate the wall of latching mechanism 24. A lever 54 is operatively coupled with lever 55 to latch arms 50 to cause movement of arms 50 toward and away from the central opening. In operation as shown in FIG. 3*a*, locking device 30 is pulled into latching mechanism 24 and moves arms 50 against springs 52 to accomodate the tapered device 30. When device 30 is moved fully past the ends of arms 50, the end of locking member 30 will abut against the locking teeth 53, as shown in FIG. 3*b*. FIG. 3*c* illustrates the operation of levers 54 and 55 by pressure on cable 29 to cause latch arms 50 to be moved toward the walls of the housing, thereby releasing locking member 30 and allowing latching mechanism 24 to be towed onboard the vessel.

Referring now to FIG. 4, the structure of paravane 40 is shown in greater detail. As shown in that figure, paravane 40 includes a top face 60, a bottom face 62, a flat or inner face 64, and a curved or outer face 66. When deployed in the operating mode the flat or inner face 64 is closest to vessel 10 and the curved face 66 faces outwardly away from the vessel. Paravane 40 is substantially wing-shaped and deployed such that the front 68 of the paravane is its leading edge as the paravane traverses the ocean. As the paravane is towed through water the wing shape of the paravane creates a force which tends to pull paravane 40 away from the vessel 10 thereby maintaining a constant tension on main line 26.

As shown in FIG. 4 paravane lines 32 and 34 are connected to stationary points on the front inner surface of paravane 40, and paravane lines 36 and 38 are connected through openings 70 and 72 and over pulley devices 74, 75, 76, and 77, respectively, to a double drum winch 78 mounted within paravane 40. Winch 78 is operatively coupled through a gear reducer 80 to a servo motor 82. Servo motor 82 is connected to a battery pack 84 through a control circuit 86 which receives one input from a generator 88 and another input from a signal transducer 90. Generator 88 is connected to a propeller device 92. As the paravane moves through the water propeller device 92 is driven by the water passing therethrough and rotates a shaft 94 to drive the generator 88.

In practice, when the operator onboard vessel 10 desires to reposition paravane 40, the operator selects the appropriate controls on the control panel onboard vessel 10 to transmit a control signal to paravane 40. The control signal is received by signal transducer 90 which in turn applies a signal to control circuit 86. Control circuit 86 in turn, outputs a control signal to the servo motor 82 which causes winch 78 to tighten or pull in the paravane lines 36 and 38 thereby pulling the back end of paravane 40 toward the vessel to increase the angle which the main line 26 makes with vessel 10. A similar operation is implemented to decrease the angle which paravane 40 makes with the direction of travel of the vessel 10. In that situation winch 78 is operated to lengthen lines 36 and 38. In this manner the operator onboard the vessel is able to selectively vary the angle of attack or incidence of paravane 40 in the water and thus alter the relative position of the paravane with respect to the vessel. Propeller driven generator 88 is operable to drive the motor 82 and battery pack 84 provides power for the control circuit 86. If desired, two separate winch devices could be substituted for the single double drum winch 78. The operator could then control the movement of the rear upper corner of the paravane or the rear lower corner of the paravane by selectively controlling either paravane line 36 or line 38 and thereby selectively control the depth at which the paravanes are deployed.

FIG. 5 shows an alternative embodiment of the paravane of the present invention. As shown in FIG. 5, a paravane 100 includes a pair of mechanically hinged rudders 108 and 110. Four paravane lines are connected to paravane 100 at stationary points on each corner thereof (not shown).

Rudder 108 is connected through a driving swivel device 112 and in turn through a first linkage 114 to a lever arm 116. Lever arm 116 is connected to a servo motor 118 which in turn is connected to a worm gear reducer 120. Worm gear reducer 120 is connected through the top face of paravane 100 to a lever arm 121 which in turn is connected through a second linkage 122 to the driving swivel device 112.

Servo motor 118 is powered by a battery pack 124 through a control circuit 126. Control circuit 126 receives inputs from a communication line pickup or transducer 128 and also from a generator 130 which is driven by a propeller 132. Servo motor 118 includes an encoder 136 operatively coupled thereto to control the operation of servo motor 118 in positioning rudder 108. Rudder 110 is similarly controlled by circuitry (not shown) located within paravane 100.

FIG. 6 is a schematic diagram of the electrical control of the paravane 100. As shown in FIG. 6, an operating panel 140 is located onboard vessel 10 which is connected to a microcomputer message decoder 142. Decoder 142 is connected to a signal transducer 144 which is operable to transmit signals to signal transducer 128 onboard paravane 100. Signals transmitted to paravane 100 from vessel 10 may be transmitted either acoustically, in which case the transducer 144 is an acoustic signal generator, or alternatively by means of hard wire cables connected to the paravane from vessel 10 along main line 26. Paravane transducer 128 is connected to control circuit 126. Control circuit 126 provides control signals to a motor drive for driving servo motor 118. Motor 118 in turn drives the rudder 108. Encoder 136 provides motor position feedback signals to the control circuit 126 to insure proper positioning of rudder 108. It should be understood that identical circuitry is provided to drive rudder 108 to insure its proper positioning.

In this embodiment, the rudders 108 and 110 are selectively operable to control the positioning of paravane 100. An operator onboard vessel 10, by selectively engaging switches on the operating panel, transmits signals which are effective when received by control circuit 126 to operate servo motor 118. Servo motor 118 then rotates driving swivel device 112 to adjust the angle of rudder 108 and thus alter the direction of paravane 100. Rudder 108 can also be controlled to selectively vary the depth at which the paravene is deployed. The same operation may be performed with respect to rudder 110 through the activation of similar circuitry located in the lower portion of paravane 100.

Although the preferred embodiment has been described in detail, it should be understood that various changes, substitutions and alterations can be made therein without departing from the spirit and scope of the invention as defined by the appended claims.

What is claimed is:

1. A deployment system for deploying a seismic cable from a vessel comprising:

a paravane connected to the seismic cable;

said paravane being coupled to the seismic cable through a hitching device connected at one end to the seismic cable and coupled to said paravane by a plurality of paravane cable lines;

direction control means onboard the vessel, said direction control means being selectively operable to transmit direction signals to said paravane;

receiving means located on said paravane for receiving said direction signals; and paravane control means coupled to said receiving means and responsive to said direction signals to cause movement of the paravane in accordance therewith; and generator means coupled to the paravane and operable to provide power to said paravane control means.

2. The deployment system of claim 1 wherein said paravane control means comprises:

a winch apparatus connected to said paravane cable lines;

a motor operatively coupled to said winch apparatus;

electronic control means coupled to said motor and responsive to said direction signals to transmit drive signals to said motor, said motor responsive to said drive signals to operate said winch apparatus to selectively vary the length of let-out cable of the paravane cable lines in accordance therewith.

3. The deployment system of claim 2 wherein said paravane cable lines comprise first and second paravane cables attached to the front corners of the paravane and third and fourth paravane cables at the rear corners of said paravane, said third and fourth paravane cables being connected to said winch apparatus.

4. The deployment system of claim 3 wherein said winch apparatus includes first and second winch devices each of said winch devices being responsive to said direction signals for independently varying the length of let-out cable of said third and fourth paravane cable, respectively.

5. The deployment system of claim 3 wherein said direction control means includes transponder means for transmitting the direction signals in the form of acoustic energy, and wherein said electronic control means includes transponder means responsive to said acoustic energy to generate electrical drive signals in accordance therewith for transmittal to said winch apparatus.

6. The deployment system of claim 1 wherein said paravane control means comprises:

rudder means located on said paravane and adapted to rotate about an axis; and rudder control means responsive to said direction signals to selectively rotate said rudder means about the axis.

7. The deployment system of claim 6 wherein said rudder control means comprises:

a drive member connected to said rudder means;

a motor operatively coupled to said drive member; and electronic control means coupled to said motor and responsive to said direction signals to transmit drive signals to said motor, said motor responsive to said drive signals to rotate said rudder means in accordance therewith.

8. The deployment system of claim 7 wherein said direction control means includes acoustic transponder means for transmitting the direction signals in the form of acoustic energy and said electronic control means includes transponder means responsive to said acoustic energy to generate electrical drive signals in accordance therewith for transmittal to said motor.

9. The deployment system of claim 7 wherein said direction control means includes electrical conductor means connected between the vessel and said paravane for transmitting the direction signals.

10. The deployment system of claim 6 wherein said rudder means comprises a pair of rudder devices, each of said devices being independently responsive to direction signals.

11. The deployment system of claim 1 wherein said direction control means includes electrical conductor means connected between the vessel and said paravane for transmitting the direction signals.

12. A deployment system for deploying a seismic cable from a vessel comprising:

a paravane connected to the seismic cable;

direction control means onboard the vessel, said direction control means being selectively operable to transmit direction signals to said paravane;

receiving means located on said paravane for receiving said direction signals;

paravane control means coupled to said receiving means and responsive to said direction signals to cause movement of the paravane in accordance therewith; and generator means coupled to the paravane and operable to provide power to said paravane control means.

13. The deployment system of claim 12 wherein said generator means comprises:

a generator device; and a propeller device coupled to said generator device, said propeller device being operative in response to fluid flowing therethrough to operate said generator device.

* * * * *